US007522400B2

(12) United States Patent
Laurent et al.

(10) Patent No.: US 7,522,400 B2
(45) Date of Patent: Apr. 21, 2009

(54) METHOD OF DETECTING AND CORRECTING RELAY TACK WELD FAILURES

(75) Inventors: Tim M. Laurent, Grandville, MI (US); Mark A. Johnson, Wheaton, IL (US); Thomas W. Degenhart, Geneva, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 392 days.

(21) Appl. No.: 11/001,573

(22) Filed: Nov. 30, 2004

(65) Prior Publication Data

US 2006/0114635 A1 Jun. 1, 2006

(51) Int. Cl.
*H01H 47/14* (2006.01)

(52) U.S. Cl. ..... 361/160; 361/168.1

(58) Field of Classification Search ..... 361/139, 361/140, 160, 161, 165, 168.1, 195, 143
See application file for complete search history.

(56) References Cited

U.S. PATENT DOCUMENTS

| | | | | | |
|---|---|---|---|---|---|
| 4,445,183 | A | * | 4/1984 | McCollum et al. | 700/294 |
| 5,373,411 | A | * | 12/1994 | Grass et al. | 361/115 |
| 5,455,733 | A | * | 10/1995 | Waggamon | 361/115 |
| 5,533,360 | A | | 7/1996 | Szynal et al. | |
| 5,604,656 | A | * | 2/1997 | Derrick et al. | 361/187 |
| 5,677,839 | A | * | 10/1997 | Kondo | 701/29 |
| 6,089,310 | A | | 7/2000 | Toth et al. | |
| 6,137,193 | A | * | 10/2000 | Kikuoka et al. | 307/137 |
| 6,472,877 | B1 | * | 10/2002 | Sands | 324/423 |
| 7,298,148 | B2 | * | 11/2007 | Drake et al. | 324/421 |

FOREIGN PATENT DOCUMENTS

| | | | |
|---|---|---|---|
| DE | 19534715 | A1 | 1/1997 |
| JP | 62137602 | A | 6/1987 |
| JP | 03089425 | A | 4/1991 |
| JP | 09259724 | A | 10/1997 |
| JP | 09293440 | A * | 11/1997 |

OTHER PUBLICATIONS

International Search Report; International Application No. PCT/US05/42563; Date of actual completion of the international search May 25, 2007; Date of mailing of the international search report Jun. 5, 2007; 3 pages.

* cited by examiner

*Primary Examiner*—Danny Nguyen
(74) *Attorney, Agent, or Firm*—Reinhart Boerner Van Deuren P.C.

(57) ABSTRACT

A method of detecting and attempting to correct a relay tack weld failure of its contacts is presented. This method senses the failure of a relay's contacts to open once it has been commanded to trip. This sensing may directly sense relay conditions, or may indirectly determine the failure by sensing a system parameter that shows the effects of the failure. Once the failure of the relay to open has been determined, the relay is again energized in an attempt to break loose the relay tack weld. If the relay fails to open after this first attempt, the relay may again be repulsed. Preferably a relay check timer is utilized to ensure that the system has stabilized before a repulse is attempted. A relay pulse timer may be used to control the pulse duration during these attempts. The number of attempts may also be limited.

12 Claims, 6 Drawing Sheets

METHOD OF DETECTING AND CORRECTING RELAY TACK WELD FAILURES

FIELD OF THE INVENTION

The present invention relates generally to relay control systems and methods, and more particularly to relay control systems and methods that address faulty relay operation.

BACKGROUND OF THE INVENTION

Relays have long been used in both consumer and commercial appliances and machinery to provide automated or electrically controlled switching operation. One of the benefits of such relays is that they allow the use of "low level" signals to switch "high level" power. That is, a typical relay includes at least one coil that pulls in or controls the switching of the main relay contacts. For some types of magnetically held relays, de-energization of the relay coil will cause the main relay contacts to open under action of a spring force or other mechanical bias. Such held relays, therefore, require that the coil be energized during the period of main contact closure (or opening in a normally-closed relay configuration). Another type of single coil relay is known as a cutthroat relay. In this relay the state of the contacts is transitioned by momentarily energizing the relay coil. That is, to open the relay if the contacts are currently closed, the relay coil is pulsed. Within the relay, a cutthroat mechanism switches over so that upon subsequent energization of the relay coil the contacts will then re-close. Latching type relays utilize two separate coils, one dedicated to open the contacts, and one dedicated to close the contacts. That is, if the contacts are currently closed, the trip coil may be pulsed to cause the contacts to open. Once the contacts have opened, there is no need to maintain energization of the trip coil. To close the contacts from this state, the close coil is energized.

While these relays utilize an electronic control signal to control the position of the main relay contacts, the contacts themselves are mechanical structures. As such, they are bound by the laws of physics. Because of this, their physical properties must be taken into account in the control circuitry and control logic for the relays. As illustrated in FIG. 8, one of the physical properties that must be taken into account when utilizing relays is the time lag between the energization of the relay coil (depicted as line 800) and the actual transition of the relay contacts (as illustrated by the relay output voltage line 802). As may be seen from this FIG. 8, the relay control circuitry energizes the relay coil at time $T_0$. Once energized, the relay coil establishes a magnetic flux that will, in this example, close the relay contacts. The actual contact closure takes place at time $T_1$. As indicated by line 802, however, the initial closing at time $T_1$ is typically followed by a short period of relay contact bounce before the relay contacts maintain their closed state at time $T_2$. This mechanical bounce is a result of the kinetic energy that is generated as the relay contacts are accelerated toward one another under the influence of the magnetic flux generated by the relay coil.

A different, but somewhat related phenomenon of intermittent contact bounce occurs between the relay contacts when they are opened. During the trip operation of an electrically held relay, the relay coil is de-energized and the relay contacts are allowed to be opened by a mechanical bias force, often provided by a spring. However, the flux generated by the relay coil is not extinguished immediately. As such, there is some initial contention between these two opposing forces. Additionally, the current flow through the relay contacts also plays a part in the slight bounce or chatter during the trip operation. With current flowing through the relay contacts, initial separation of the contacts results in an arc being drawn between the two contacts which tends to pull the contacts together. Until the spring force can overcome these opposing forces, inconsistent opening may occur for a short time. Similar bounce or chatter is also seen for the other types of relays described above that require coil energization to open the contacts.

While the delay in opening and closing the relay contacts can be compensated in the control circuitry and logic, the contact bounce phenomenon occasionally results in a mechanical failure of the relay. Specifically, and especially when supplying high in-rush capacitive, motor, lamp, and overloads through the relay, the relay bounce results in an arc being drawn between the relay contacts at each bounce. As a result of this arcing, the metal that forms the relay contacts may become molten at a small and localized point. When the contacts come back together, this molten material of the relay contacts may form a small tack weld. This tack weld prevents the relay contacts from opening under normal operation. A similar situation may occur during the opening of the relay coil, especially with relays that utilize separate trip coils due to the time required to establish sufficient flux to separate the contacts in high current applications. This problem may become especially acute in applications that use coil suppression techniques in the driver circuitry of such trip coils.

As a result of the relay tack weld failure, the relay contacts remain closed, and the load to which they are connected cannot be de-energized. If this problem happens to the control relay of, for example, a compressor in a refrigerator, the compressor cannot be de-energized once the temperature in the freezer or fresh food compartment has reached its desired set point. This will result in the temperature set point being exceeded by continued operation of the compressor. As a result, the owner will be forced to make a service call to correct this problem.

Because the actual area of the relay contact surface that is tack welded is typically very small, the removal of the relay by service personnel to investigate the cause of the failure often results in breaking this physical tack weld. When the relay is subsequently tested, it may operate normally. This may be reported as a "could-not-duplicate" failure or may result in further, needless investigation of other potential causes for failure. Often, this may lead to a costly replacement of the control board that contains the relay driver circuitry. This may well result in needless loss of time and additional expense for the consumers, not to mention the frustration that may be caused by the initial failure of the relay itself.

There exists, therefore, a need in the art for a relay control method that can detect a relay tack weld failure, and attempt to correct this failure before service personnel needs to be called.

BRIEF SUMMARY OF THE INVENTION

In view of the above, it is an object of the present invention to provide a new and improved relay control method that overcomes the above and other problems existing in the art. More particularly, it is an objective of the present invention to provide a new and improved relay control method that is capable of detecting a relay tack weld failure and that will attempt to resolve this failure without user intervention to preclude the necessity of scheduling a service call.

In view of these objects, it is a feature of the present invention to sense the relay tack weld failure through direct sensing of the circuitry involved. It is an alternate feature of the present invention to detect such a relay tack weld failure indirectly by sensing a system parameter that shows consequences of the failure condition. Once detected, it is a further feature of the present invention to attempt to electromechanically resolve the tack weld failure automatically. It is also a feature of the present invention to limit the automatic attempts to resolve the tack weld failure to prevent other failures within the relay control system.

In one embodiment of the method of the present invention, the existence of the relay tack weld failure is first detected. This detection may be the result of sensing relay circuit parameters, such as output voltage or current flow after the relay has been commanded to the trip. Auxiliary contacts of a relay may be used in one embodiment. Alternatively, this step of detecting the relay tack weld failure may be accomplished by sensing other parameters that may be affected by continued operation of the load which the relay controls. In an embodiment of the present invention wherein the method is implemented in a refrigerator for control of a compressor, this indirect sensing may include the step of sensing the compartment temperature. If the compartment temperature continues to drop after the compressor has been commanded off, a relay tack weld may have occurred. In other embodiments where the method of the present invention is implemented in a furnace, continued presence of flame or continued rise in ambient temperature sensed by the thermostat may also provide indication of a possible relay tack weld failure.

In a preferred embodiment of the present invention, the method attempts to recycle the relay. Preferably the number of recycles attempted is limited to prevent other damage from occurring in the relay control circuitry. For a magnetically held relay, the close coil is energized and de-energized a number of times in an attempt to break the tack weld. If the relay opens, the recycling of the relay is discontinued to preclude subsequent tack welding of the contacts. In an embodiment of the present invention implemented for control of a cutthroat relay, the relay coil is pulsed a number of times in an attempt to break the relay tack weld. In an embodiment of the present invention to control a latching type relay having both close and trip coils, the method may pulse the trip coil a number of times, or may alternatively pulse the close and trip coil a number of times in an attempt to break the relay tack weld. In any of these embodiments, recycling of the relay is stopped once the contacts open.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

While the relay control method of the present invention may be implemented in any system that utilizes electromechanical relays, the following description will describe the operation of this method in the context of a method of controlling a compressor control relay in a consumer refrigerator. However, such an environment is utilized for illustrative purposes only, and is not limiting to the scope of the invention as defined by the appended claims. Additionally, while other environments in which the method finds applicability may be mentioned or discussed herein, such other implementations are also provided to give the reader context and aid in the understanding of the invention, and should also not be taken as limiting the scope of the invention.

Figure 1:
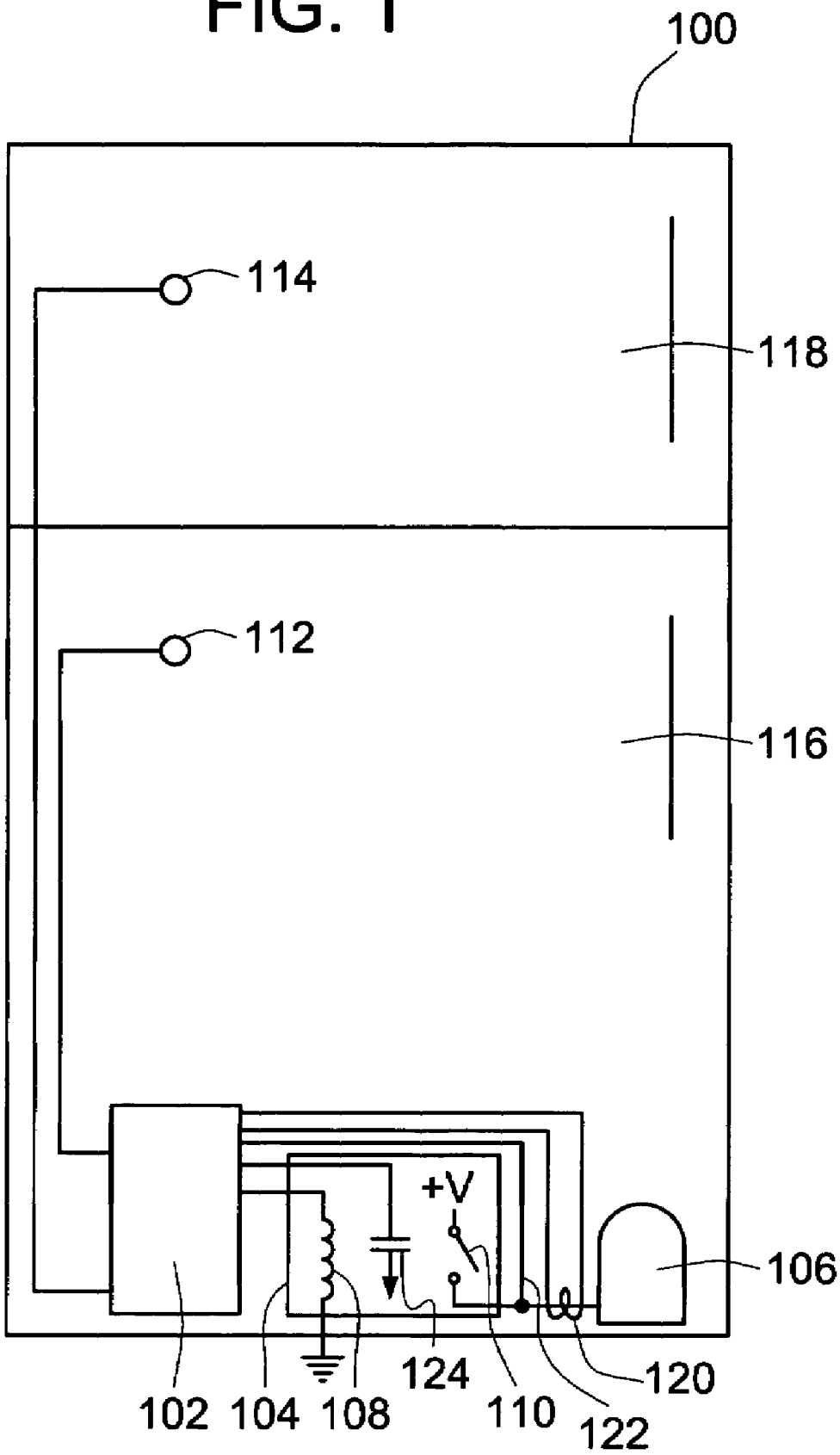
FIG. 1 is a simplified illustration of a refrigerator utilizing a relay to control a compressor in which the method of the present invention has particular applicability.

As illustrated in FIG. 1, a consumer or commercial refrigerator 100 typically includes some type of controller 102 that includes control logic, sensing circuitry, and, output control circuitry to control, for example, the compressor control relay 104. This compressor control relay 104 allows the controller 102 to turn the compressor 106 on and off by energizing the relay coil 108 to cause the main relay contacts 110 to close. In this exemplary embodiment, the relay 104 is a magnetically held relay that requires the coil 108 to be energized in order for the power to be provided to the compressor 106 via the contacts 110. When the coil 108 is de-energized by the controller 102, a mechanical bias force will result in the relay contacts 110 opening to de-energize the compressor 106. However, while this exemplary embodiment is described as using a magnetically held relay, those skilled in the art will recognize that other types of relays may also be utilized in such a system to provide control of the compressor 106, as will be discussed more fully below. The controller 102 may also include temperature sensors 112, 114 for the fresh food compartment 116 and the freezer compartment 118, respectively. The controller 102 may also include a relay circuit parameter sensor. As illustrated in FIG. 1, this sensor may be a current sensor 120, relay output voltage sense line 122, and/or relay auxiliary contact sense 124, etc.

In such an environment as that illustrated in FIG. 1, the compressor control logic programmed into controller 102 will utilize the temperature sensors 112, 114 to determine when the compressor 106 needs to be turned on to maintain the fresh food compartment 116 and the freezer compartment 118 at their desired preset temperatures. Once the controller 102 determines that the compressor 106 needs to be turned on to provide additional cooling to the refrigerator 100, it commands its driver circuitry to energize the relay coil 108. This will result in the relay contacts 110 (and also the auxiliary contacts 124) to close. Once closed the compressor 106 is energized though contacts 110 and begins the cooling process for the refrigerator 100.

Once the controller 102 determines that the desired amount of cooling has been provided by the compressor 106, it commands its driver circuitry to de-energize relay coil 108. Under normal circumstances, the mechanical bias of the magnetically held relay 104 will cause the relay contacts (and also the auxiliary contacts 124) to open. Once the relay contacts 110 are opened, the compressor 106 is de-energized. However, if a relay tack weld failure has occurred either during the initial closing of contacts 110 or during the attempted tripping of contacts 110, the compressor 106 will continue to be energized, and will continue to provide cooling to the refrigerator 100.

Figure 2:
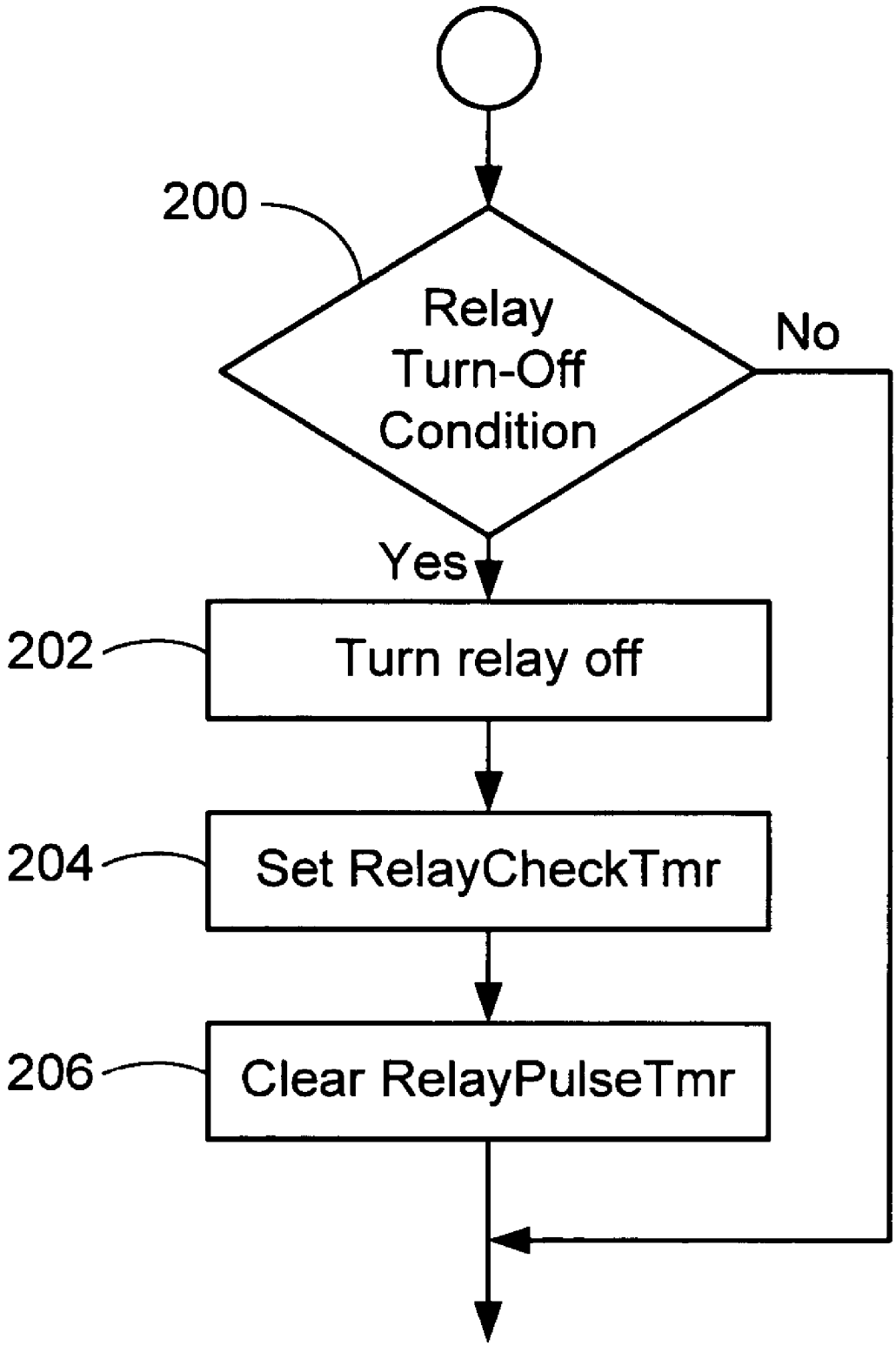
FIG. 2 is a simplified flow diagram illustrating one aspect of an embodiment of the method of the present invention.

In an attempt to overcome this problem, the method of the present invention detects abnormal operation when the relay is commanded to open. As illustrated in FIG. 2, the method of the present invention first determines if a relay turn off condition has occurred at step 200. If not, the method illustrated in FIG. 2 ends and allows the controller 102 to continue cycling through its other control algorithms. If, however, a relay turn off condition has occurred as determined by decision block 200, such as the temperature reaching its desired set point, the controller 102 then operates to turn the relay off at step 202. As discussed above with regard to the magnetically held relay, this will result in the driver circuitry of controller 102 de-energizing the relay coil 108. The method of the present invention then sets a relay check timer at step 204, and clears a relay pulse timer at step 206.

The relay check timer is utilized in an embodiment to the present invention to establish a period of time after which a relay tack weld failure may reliably be detected. Depending on the type of sensor utilized to determine the relay tack weld failure, this check timer period may vary. For example, if a voltage, current or auxiliary contact sense is used, this relay check timer may be short, ranging from a few milliseconds to a few seconds. However, in embodiments of the present invention that utilize indirect sensing, such as temperature sensing within the refrigerator 100, the relay check timer may need to be much longer, possibly on the order of several minutes. Such timing may easily be determined by those skilled in the art based on the settling time of the parameter being monitored during normal operation of the system.

The relay pulse timer establishes the pulse duration during which the coil will be energized in an attempt to free the tack welded relay contacts. This pulse duration may be relatively short, and need provide energization only until sufficient magnet flux can be generated by the coil to cause a bias force on the contacts by the magnet flux. While longer duration pulses may be utilized, it is the mechanical shock provided by the magnet flux that is likely to break the tack weld, not establishing a steady state held position by continuing to energize the relay coil. Those skilled in the art will recognize that the use of such a relay pulse timer may not be needed for other types of relays, such as cutthroat relays or mechanical latching relays, as typical relay controllers for these types of relays already only provide a pulse of sufficient duration under normal operation to transition the relay contacts. In other words, the normal relay control provides its own relay pulse duration mechanism.

Figure 3:
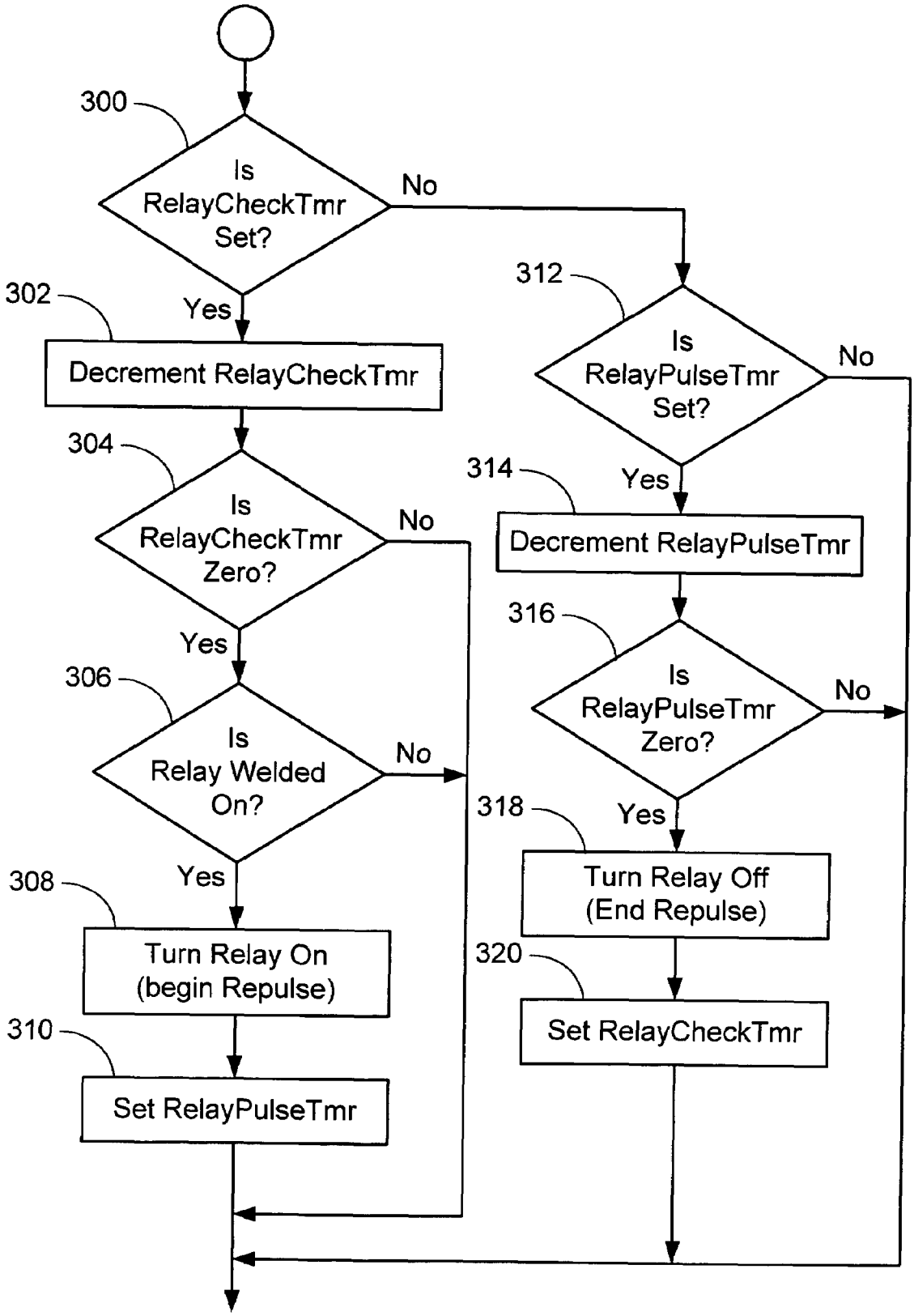
FIG. 3 is a simplified flow diagram illustrating another aspect of an embodiment of the method of the present invention.

FIG. 3 illustrates the tack weld failure determination method and the relay recycling procedure that attempts to clear the relay tack weld. Initially this embodiment of the method of the present invention checks to determine if the relay check timer has been set by the relay control method of FIG. 2 at decision block 300. If the relay check timer has been set, meaning that the relay control of FIG. 2 has attempted to trip open the relay, the method proceeds to decrement the relay check timer at step 302. Decision block 304 then checks to see whether the relay check timer has reached zero or its time-out condition. If it has not, this method ends and allows the controller 102 to continue cycling through its other control algorithms. However, once the relay check timer has reached zero as determined by decision block 304, a check is made to see if the relay is welded in its closed or on position at decision block 306. As discussed above, this determination may be made by utilizing various sensors (direct or indirect) to determine if the load remains powered due to a tack weld failure of the relay.

If it is determined that the relay has a tack weld failure, then the method will turn on the relay to begin its repulse at step 308. To control the duration of the pulse in this embodiment utilizing a held relay, the method then sets the relay pulse timer at step 310. For other embodiments in which the normal relay control provides an appropriate pulse width to control the relay, this step is not required. Such may be the case, e.g., for cutthroat and latching type relays. If at decision block 306 it is determined that the relay has properly opened its contacts, this method will end and allow the controller 102 to continue cycling through its other control algorithms.

Returning to decision block 300, if it is determined that the relay check timer is not set, either because the relay has not been commanded off or because the relay check timer has been decremented to zero and the repulse has begun, decision block 312 is then used to determine if the relay pulse timer is set. If the relay pulse timer has not been set, this means that the relay has not been commanded off and this method ends to allow the controller 102 to continue cycling through its other control algorithms. However, if decision block 302 determines that the relay pulse timer has been set (via step 310), then the method begins decrementing the relay pulse timer at step 314 to control the pulse duration. Decision block 316 then checks the relay pulse timer to determine whether it has expired. If it has not, this method ends to allow the controller 102 to continue cycling through its other control algorithms. However, once the relay pulse timer has reached zero as is determined by decision block 316, step 318 will turn off the energization to the relay coil 108 to end the repulse at step 318. The method of the present invention then sets the relay check timer at step 320 to once again check to see if the relay tack weld failure has been corrected and the relay has opened.

As illustrated in FIG. 3, there is no limitation to the number of times that the repulse will be attempted to try and overcome the tack weld failure. That is, if the relay contacts remain welded together, the embodiment of the present invention illustrated in FIG. 3 will continue to repulse the relay after the expiration of the relay check timer and after confirming that the relay is still closed, until the contacts open. However, in an alternate embodiment of the present invention, a limitation to the number of repulse attempts may be set as desired. In such an embodiment, a counter may be implemented to count each repulse attempt until the maximum desired number of repulse attempts has been reached. The method of the present invention may then also include error reporting identifying the relay tack weld failure. If the relay is opened by the method of the present invention, however, there is no need to report the failure because such tack welds are occasional occurrences. However, if desired, the method of the present invention may also provide error reporting upon the first occurrence of the tack weld failure, whether or not this problem is overcome by any of the methods of the present invention.

Figure 4:
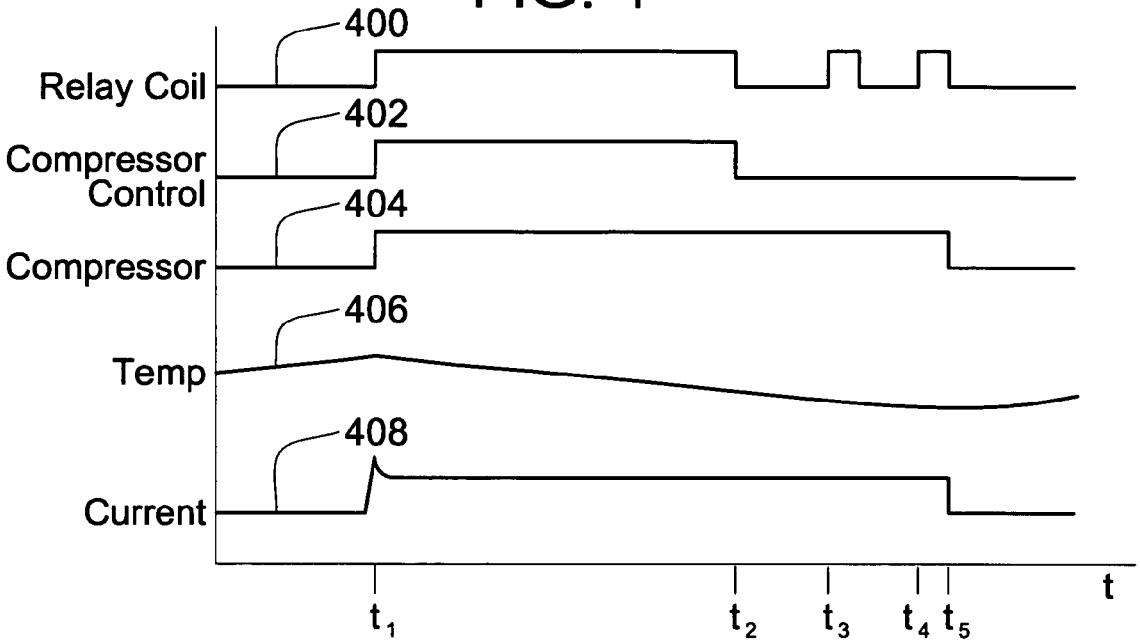
FIG. 4 is a graphical illustration of various control parameters that illustrate operation of the method of the present invention when controlling a magnetically held relay.

Having now described the operation of an embodiment of the method of the present invention, attention is directed to FIG. 4. This FIG. 4 graphically illustrates the relay tack weld failure problem and the operation of the method of the present invention to break the tack weld in the refrigerator example. Specifically, FIG. 4 illustrates the operation of an embodiment of the method of the present invention usable with a magnetically held relay. In this figure, line 400 represents the state of the energization of the relay coil, line 402 illustrates the state of the compressor control command to turn the compressor on and off, line 404 illustrates the operational state of the compressor, line 406 represents the temperature within the refrigerator 100, and line 408 represents the current supplied to the compressor through the relay contacts.

As illustrated in FIG. 4, the compressor is initially de-energized and the temperature illustrated by line 406 is rising within the refrigerator 100. At time $T_1$ the temperature 406 reaches the control point at which the controller 102 signals via the compressor control 402 that the compressor is to be turned on. The relay coil 400 is energized to close the relay contacts to, in turn, energize the compressor. Energization of the compressor is illustrated by the spike in current at time $T_1$ on line 408. Once the compressor is running, the temperature 406 within refrigerator 100 decreases.

At time $T_2$ the temperature 406 within refrigerator 100 has reached its lower threshold. The compressor control 402 is then taken low by controller 102, indicating that the compressor is to be turned off. Since FIG. 4 illustrates the usage of a magnetically held relay, the relay coil energization is also turned off at this time $T_2$. However, because a relay tack weld failure exists, the compressor is not de-energized at time $T_2$, and the temperature 406 continues to drop within the refrigerator 100. Once the relay check timer has expired as illustrated at time $T_3$, the method of the present invention operates to re-energize or repulse the relay coil in an attempt to break the relay tack weld. The duration of the repulse at time $T_3$ is controlled by the relay pulse timer discussed above. As illustrated in this FIG. 4, however, this first repulse is not successful in breaking the relay tack weld as illustrated by the continued energization of the compressor. Therefore, at time $T_4$ the relay check timer has again expired and the coil is then repulsed. Once the relay pulse timer has expired at time $T_5$ the relay coil is de-energized. As illustrated in this FIG. 4, this second repulse was successful in breaking the relay tack weld and the compressor is de-energized at time $T_5$ once the second repulse ends and the relay contacts open.

Figure 5:
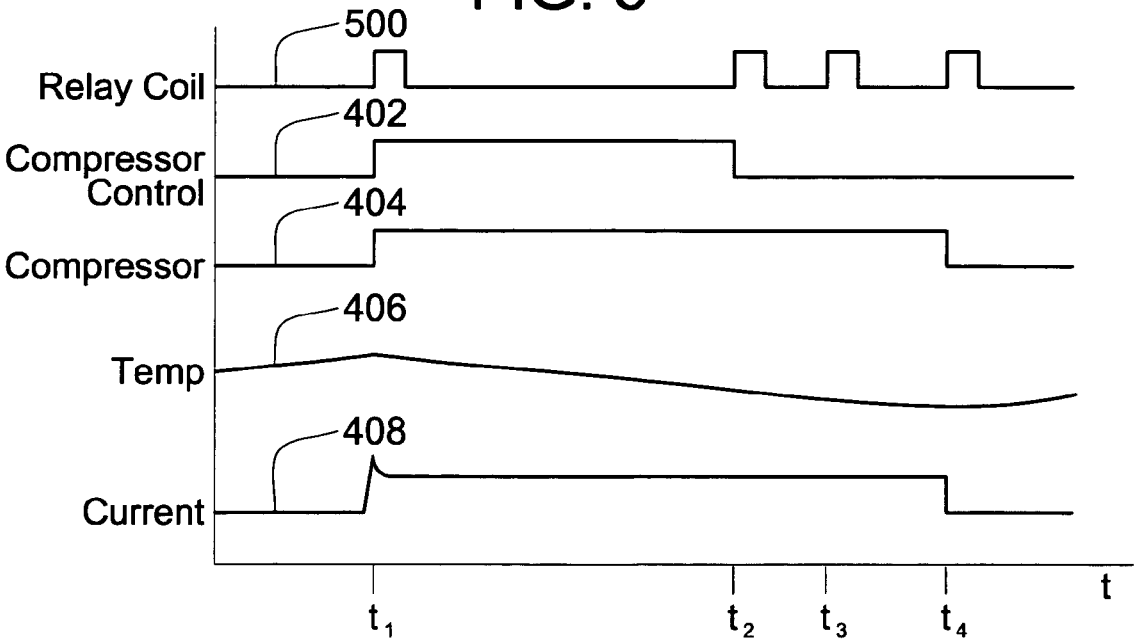
FIG. 5 is a graphical illustration of various control parameters that illustrate operation of the method of the present invention when controlling a cutthroat relay.

FIG. 5 illustrates the same information for lines 402-408, but utilizes a cutthroat type relay. As is recognized by those skilled in the art, a cutthroat relay is a latching type relay having a single relay coil that is used to both open and close the relay contacts based on the current state of the relay contacts. As illustrated in this FIG. 5, initially the compressor is off and the temperature is rising within refrigerator 100. At time $T_1$ the controller 102 commands the compressor on and the relay coil 500 is energized to close the relay contacts and energize the compressor. During compressor energization the temperature drops within refrigerator 100. At time $T_2$ the lower threshold temperature is reached and the controller 102 turns off the compressor control command 402. The relay coil is pulsed at time $T_2$ in an attempt to open the relay contacts and de-energize the compressor.

However, due to a relay tack weld failure the contacts fail to open. Therefore, at time $T_3$ after the expiration of the relay check timer, the relay coil is again pulsed in an attempt to break the relay tack weld. Because the relay contacts did not open, the cutthroat mechanism does not operate. Therefore, repulsing of the relay coil will again attempt to simply open the contacts. At time $T_4$ the relay coil is again pulsed after the expiration of the relay check timer has determined that the relay contacts are still welded closed. On this second repulse attempt the relay tack weld is broken and the compressor is de-energized at time $T_4$.

Figure 6:
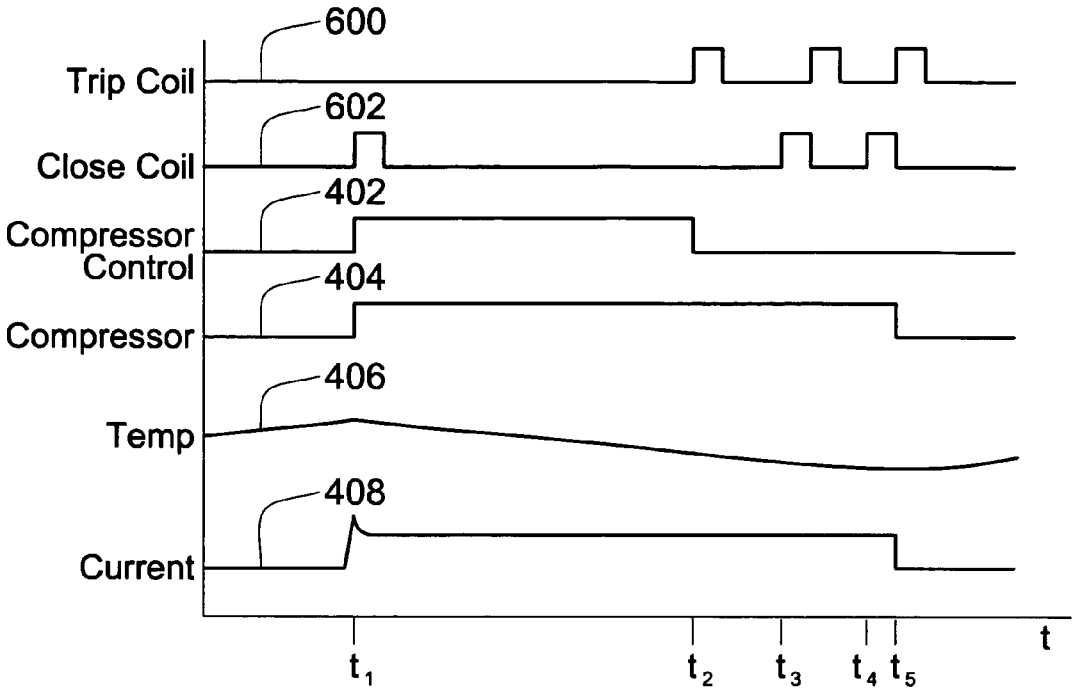
FIG. 6 is a graphical illustration of various control parameters that illustrate operation of the method of the present invention when controlling a latching relay.

FIG. 6 illustrates a further alternate embodiment of the present invention for use with a latching type relay having both a trip and a close coil as represented by lines 600 and 602, respectively. As with the previous two figures, FIG. 6 illustrates the same initial conditions and the same command to energize the compressor at time $T_1$. Also, at time $T_2$ the compressor control command indicates that the compressor is to be de-energized and the trip coil 600 is energized. However, due to the relay tack weld failure the contacts fail to open and the compressor remains energized. At time $T_3$, after expiration of the relay check timer, the close coil is first energized followed by an energization of the trip coil in an attempt to break loose the relay tack weld. Unfortunately, FIG. 6 illustrates that this first attempt is unsuccessful in de-energizing the compressor. Therefore, at time $T_4$ after expiration of the relay check timer, the close and trip coils are again energized in sequence. Once the trip coil has been energized at time $T_5$, the compressor is de-energized because this second attempt is successful at breaking the relay tack weld.

Figure 7:
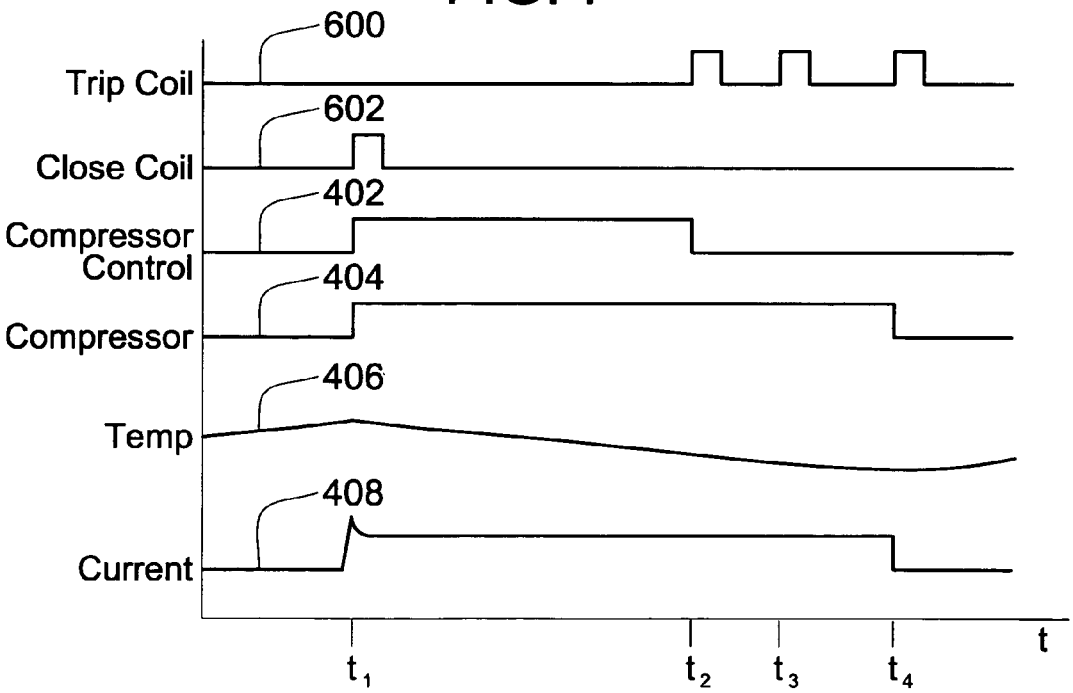
FIG. 7 is a graphical illustration of various control parameters that illustrate operation of an alternate embodiment of the method of the present invention when controlling a latching relay.
Figure 8:
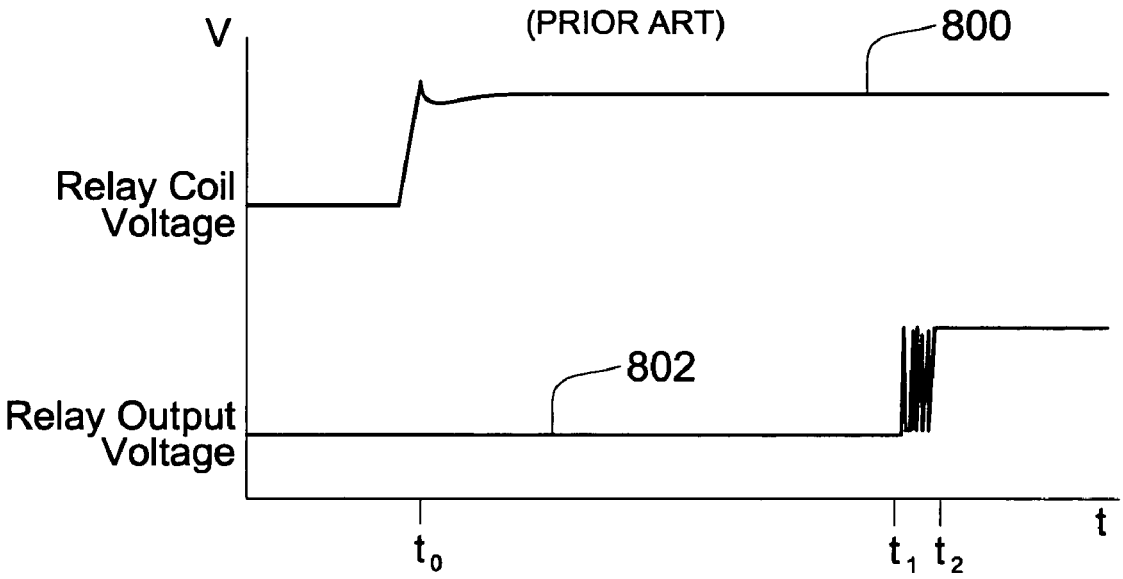
FIG. 8 (PRIOR ART)
FIG. 8 is a simplified graphical illustration of the control and closing of a typical relay.

FIG. 7 illustrates an alternate embodiment of the present invention for use with a latching type relay. In this embodiment the close coil is not energized prior to attempting to again trip the relay by energizing the trip coil as discussed above in FIG. 6. Specifically, upon the initial attempt to de-energize the compressor at time $T_2$ in response to the compressor control command 402 indicating that the compressor is to be de-energized, the relay contacts fail to open due to the relay tack weld failure. At time $T_3$ after the expiration of the relay check timer the trip coil 600 is again energized in an attempt to break loose the relay tack weld. Unfortunately, this first repulse attempt is unsuccessful as evidenced by the continued energization of the compressor. The trip coil is again energized to repulse the relay at time $T_4$ after the expiration of the relay check timer. This time the repulse attempt is successful in breaking loose the relay tack weld and the compressor is de-energized at time $T_4$.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of controlling a relay, comprising the steps of:

commanding the relay to open;

determining whether the relay has opened;

repulsing the relay in an attempt to open the relay when the step of determining indicates that the relay has not opened;

setting a relay check timer after the step of commanding the relay to open, and wherein the step of determining is performed only after the relay check timer has expired; and wherein the relay is a magnetically held relay having a single relay coil, wherein the step of commanding the relay to open comprises the step of de-energizing the relay coil, and wherein the step of repulsing the relay comprises the step of re-energizing the relay coil for a predetermined period.

2. The step of claim 1, wherein the step of determining whether the relay has opened comprises the step of monitoring a system parameter.

3. The step of claim 2, wherein the step of monitoring a system parameter comprises the step of monitoring a temperature of an area affected by a closed relay.

4. The step of claim 2, wherein the step of monitoring a system parameter comprises the step of monitoring an existence of a flame.

5. A method of controlling a relay, comprising the steps of:

commanding the relay to open;

determining whether the relay has opened;

repulsing the relay in an attempt to open the relay when the step of determining indicates that the relay has not opened;

setting a relay check timer after the step of commanding the relay to open, and wherein the step of determining is performed only after the relay check timer has expired; and wherein the relay is a cutthroat relay having a single relay coil, wherein the step of commanding the relay to open comprises the step of energizing the relay coil, and wherein the step of repulsing the relay comprises the step of re-energizing the relay coil.

6. A method of controlling a relay, comprising the steps of:

commanding the relay to open;

determining whether the relay has opened;

repulsing the relay in an attempt to open the relay when the step of determining indicates that the relay has not opened;

setting a relay check timer after the step of commanding the relay to open, and wherein the step of determining is performed only after the relay check timer has expired; and wherein the relay is a latching relay having a trip coil and a close coil, wherein the step of commanding the relay to open comprises the step of energizing the trip coil, and wherein the step of repulsing the relay comprises the step of energizing the close coil followed by the step of energizing the trip coil.

7. A method of controlling a relay, comprising the steps of:

commanding the relay to open;

determining whether the relay has opened;

repulsing the relay in an attempt to open the relay when the step of determining indicates that the relay has not opened;

setting a relay check timer after the step of commanding the relay to open, and wherein the step of determining is performed only after the relay check timer has expired; and wherein the relay is a latching relay having a trip coil and a close coil, wherein the step of commanding the relay to open comprises the step of energizing the trip coil, and wherein the step of repulsing the relay comprises the step of energizing the trip coil.

8. A method of controlling a relay, comprising the steps of:

commanding the relay to open;

determining whether the relay has opened; and repulsing the relay in an attempt to open the relay when the step of determining indicates that the relay has not opened;

counting each step of repulsing; and repeating the steps of determining, repulsing and counting until the step of counting reaches a predetermined limit unless the step of determining indicates that the relay has opened.

9. The method of claim 8, wherein the step of determining whether the relay has opened comprises the step of monitoring a relay parameter.

10. The step of claim 9, wherein the step of monitoring a relay parameter comprises the step of monitoring an output voltage of the relay.

11. The step of claim 9, wherein the step of monitoring a relay parameter comprises the step of monitoring an output current of the relay.

12. A method of detecting and correcting a relay tack weld failure, comprising the steps of:

determining whether the relay has opened after it has been commanded to open;

pulsing the relay in an attempt to break the relay tack weld when the step of determining indicates that the relay has failed to open after it has been commanded to open;

waiting a predetermined period of time after the relay has been commanded to open before the step of determining; and wherein the step of pulsing the relay comprises the step of energizing a close coil of the relay for a predetermined period of time; and wherein the step of pulsing the relay further comprises the step of energizing a trip coil of the relay for a predetermined period of time after the step of energizing the close coil.

* * * * *